US006996873B2

(12) United States Patent
Salmon

(10) Patent No.: US 6,996,873 B2
(45) Date of Patent: Feb. 14, 2006

(54) DEVICE FOR SQUEEZING LIQUID-ABSORBING WIPER BODIES

(75) Inventor: Dirk Salmon, Wertheim (DE)

(73) Assignee: Vermop Salmon GmbH, Wertheim (DE)

( * ) Notice: Subject to any disclaimer, the term of this patent is extended or adjusted under 35 U.S.C. 154(b) by 403 days.

(21) Appl. No.: 10/251,272

(22) Filed: Sep. 20, 2002

(65) Prior Publication Data

US 2003/0056315 A1 Mar. 27, 2003

Related U.S. Application Data

(60) Provisional application No. 60/324,451, filed on Sep. 24, 2001.

(51) Int. Cl.
*A47L 13/59* (2006.01)
*A47L 13/58* (2006.01)

(52) U.S. Cl. ..... 15/261; 15/260

(58) Field of Classification Search ..... 15/260, 15/261; 100/233, 234
See application file for complete search history.

(56) References Cited

U.S. PATENT DOCUMENTS 456,666 A * 7/1891 White ..... 15/261
707,235 A * 8/1902 Von Kanel ..... 15/261
969,229 A 9/1910 Wetmore
1,434,534 A * 11/1922 Eiffe ..... 15/261

FOREIGN PATENT DOCUMENTS

| | | |
|---|---|---|
| DE | 9409601.5 | 1/1995 |
| DE | 9416565.3 | 1/1995 |
| DE | 29818942 U1 | 2/1999 |
| DE | 100 08 331 A1 * | 9/2001 |
| EP | 0 788 762 B1 | 8/1997 |
| EP | 1 089 648 B1 | 4/2001 |

* cited by examiner

*Primary Examiner*—John Kim
*Assistant Examiner*—Laura C Cole
(74) *Attorney, Agent, or Firm*—Wolf, Greenfield & Sacks, P.C.

(57) ABSTRACT

A device for squeezing liquid-absorbing wiper bodies consists of first and second press jaws, each of which has two principal faces and side faces at right angles thereto, where the first press jaw is connected with the second by means of an articulated joint, a press lever connected with the first press jaw by means of an articulated joint, a clamping device for clamping the first and second press jaws, said clamping device being connected with the press lever, and a fixing arrangement for the device provided on the second press jaw.

18 Claims, 5 Drawing Sheets

DEVICE FOR SQUEEZING LIQUID-ABSORBING WIPER BODIES

CROSS-REFERENCE TO RELATED APPLICATION

This application claims the benefit of provisional application Ser. No. 60/324,451, filed Sep. 24, 2001, which is hereby incorporated herein by reference in its entirety.

FIELD OF THE INVENTION

The invention concerns a device for squeezing liquid-absorbing wiper bodies for the cleaning of absorption surfaces of the wiper bodies.

A cleaning system for the moist or wet wiping of floor surfaces consists of a holder with a mop covering and a squeezing device for the mop covering. The provision of these elements assures that the moisture absorbed by the mop covering can be at least partly squeezed out of the mop covering before the cleaning of a floor surface is commenced or continued.

The squeezing device serves to accommodate a mop covering introduced into it, where said mop covering is generally tensioned onto a holder, and, moving press jaws towards each other, to exert a force on the mop covering that serves to squeeze the liquid out of it. Such a device for the squeezing out of liquids may either be placed onto a bucket or a similar receptacle or be permanently integrated into such a receptacle. The liquid squeezed out of the mop covering will thus be collected in the receptacle. Furthermore, said receptacle may be used to contain a liquid for cleaning the mop covering, so that the mop covering can be dipped into this liquid before it is subjected to the squeezing and is thereby cleaned.

BACKGROUND OF THE INVENTION

Devices for squeezing liquids out of mop coverings while mounted on a holder are known to the prior art. In particular, such devices are being used for what are essentially rectangular mop holders and coverings.

As a rule, the devices comprise two press jaws between which the mop covering is squeezed while mounted on the holder. The press jaws can move between an open position and a closed position in which the actual squeezing is performed. To this end, the prior art avails itself of devices that consist of two press jaws that are shaped so as to be essentially identical and symmetrical with respect to each other, so that a mop covering mounted on a mop holder can be squeezed on both sides of the mop holder.

Such a device is described in DE-9 416 565.3 U1. The device comprises two press jaws, each of which is mounted by means of four pins in grooves provided for this purpose in the bucket. For one of the press jaws, the grooves provided to guide the press jaws extend parallel to the introduction direction of the bucket along its inner wall. The other press jaw is guided by appropriately shaped grooves along a curved track, so that, given a downward movement in the introduction direction of the wiping mop with the mounted mop covering, it will follow a curved track. The track is shaped in such a manner that the second press jaw, which in its initial state, i.e. in the open condition, is situated at an angle with respect to the first press jaw, will rotate in the direction towards the first press jaw until it eventually comes to be parallel to it, where the mop holder with the mounted mop covering will come to lie between the two press jaws. Each of the press jaws is provided with openings, so that the liquid squeezed out can readily flow away. Furthermore, the press jaws are also provided with raised parts that likewise serve to improve the squeezing process. In order to initiate the movement of the press jaws, each of the press jaws is provided with a supporting bracket at right angles to the direction of motion of the mop holder against which the mop holder is pressed when being introduced thus initiating the downward motion.

In the case of this device, which is arranged in a receptacle for the accommodation of cleaning liquid, the entire squeezing force has to be applied by the user exerting mechanical pressure force onto the supporting brackets. Moreover, when the mop holder is withdrawn from the device, there is a danger that the device will get wedged, in which case considerable force will have to be used to free the mop holder.

Another device for the squeezing of liquid-absorbing wiper bodies is described in DE 9 409 601.5 U1. Also this device comprises two essentially plate-shaped press jaws together forming a V when they are in their open position. One of the two press jaws is fixed firmly to L-shaped tubes and cannot move, while the other of the two press jaws is movably supported on the L-shaped tubes. A foot pedal situated between the L-shaped tubes is linked to the mobile press jaw by means of a connecting element, so that operation of the foot pedal causes the movable press jaw to move towards the first fixed press jaw and to be pressed against it. The press jaws are also provided with openings. Additionally, wringing rollers are mounted on their upper ends. Using an appropriate U-bracket, the entire device can be attached to a bucket.

Since the first of the press jaws is in an oblique and fixed position, a mop holder with a mounted mop covering will likewise have to be introduced and squeezed in this oblique position. on the one hand, this is disadvantageous as regards the removal of the dirty water and, on the other hand, as regards the handling of the mop holder by the user. Lastly, the device described in DE 9 409 601.5 U1 significantly projects above the upper edge of the bucket, which implies the danger that the user or accessories employed by him will become entangled with the structure, so that under certain circumstances the entire bucket with the dirty water will be tilted over. Lastly, the guidance of the displacement mechanism mounted in the tubes implies the danger that this mechanism will get stuck, so that an opening or closing of the press jaws becomes only possible by the exertion of a force. Moreover, the transfer of force is not enhanced by means of a lever, so that the entire squeezing force has to be provided directly by the user.

SUMMARY OF THE INVENTION

It is an object of the invention to provide a device for squeezing liquid-absorbing wiper bodies which allows an even squeezing of a wiper body at reduced force which may, in addition, be fixed within a receptacle.

This object is realized by a device for squeezing liquid-absorbing wiper bodies comprising:

first and second press jaws, each of which has two principal faces and side faces at right angles thereto, where the first press jaw is connected with the second press jaw by means of an articulated joint;

a press lever connected with the first press jaw by means of an articulated joint;

a clamping device for clamping the first and the second press jaw, said clamping device being connected with the press lever; and a fixing arrangement for the device provided on the second press jaw.

The invention is based on the idea to essentially enlarge the known devices by one additional element, namely a clamping device connected to a press lever. Upon appropriate operation of the press lever and with the clamping device in its closed position, this makes it possible to use the lever action to transfer a force to the press jaws that will bring said jaws into a closed position and thus squeeze the wiper mop with the mounted wiper covering. A smaller force has to be applied when this is done, since the device exploits the relatively long lever effect of the press lever relative to a distance of the bearing points between press lever and clamping device or press lever and press jaw. Furthermore, the entire device can be mounted inside a receptacle, so that the whole device is designed in a space-saving manner. In view of the fact that the press jaws are parallel to each other during squeezing and, when appropriately mounted inside a receptacle, are positioned vertically, it is possible to obtain a uniform squeezing of the mop covering on both sides of a mop holder, with the squeezed liquid being reliably removed and the user being able to work in an ergonomic manner due to the relatively small force which has to be applied.

Advantageous embodiments are characterized by the remaining claims.

The device for the squeezing of liquid-absorbing wiper bodies will thus advantageously consist of essentially rectangular press jaws that in their built-in position have two principal surfaces facing each other and each jaw has four end faces, i.e. two lateral end faces and an upper and a lower end face. This design of the press jaws makes it possible to squeeze conventional and essentially rectangular wiping systems with two working faces. Some of the known wiping systems have a wiper covering on both working sides of a holder board that can be swiveled about a joint. Given the rectangular shape of the press jaws, the form of the jaws matches the form of the mop holder with the mop covering.

According to a preferred embodiment of the invention, the articulated joint between the first and the second press jaws is situated in the lower part of the press jaws when they are in their built-in position. Furthermore, the press lever is connected to an area of the first press jaw that is situated at a distance from the joint between the first and the second press jaws. This once again makes possible not only optimal exploitation of the space conditions in a receptacle on which the device is mounted, but also assures optimal exploitation of the lever action.

The press lever is preferably designed in an U-shaped manner. This means that the press lever is supported on the first press jaw by a joint at each end of the U. The U-shaped design, together with the appropriate bearing, renders possible a particularly ergonomic manner of working, since the press lever can be gripped and operated anywhere along the transverse part of the U. In combination with an appropriately designed end of the leg of the U and correspondingly designed devices at a receptacle, so that the legs of the U can engage with said devices on the receptacle in a carrying position, the grip on the press lever can simultaneously serve as carrying device.

The press lever is preferably attached to the first press jaw by means of two bearing points arranged in a symmetrical position with respect to each other. Such a symmetrical arrangement of the bearing points of a U-shaped press lever prevents an asymmetrical application of the force and this, in turn, assures a uniform squeezing of the wiper body. Furthermore, such a symmetrical arrangement and the consequently obtained uniform force application reduces wear due to one-sided wear or wedging of the component parts.

Advantageously, each bearing point is situated on the side faces of the press jaws, especially at the end side faces thereof. This will make it possible to use the entire surface of the press jaw for squeezing. No impairment by the bearings of the press lever will occur. Furthermore, a particularly simple design becomes possible when the press lever it supported at the end side faces, since in view of a complete closing of the press jaws with each other it is not required to take into account a bearing point in the squeezing area.

According to a preferred embodiment, the clamping device comprises at least one clamping lever which is attached to the press lever by means of an articulated joint and a latch attached to the second press jaw. The latch has to be made to engage with the end of the clamping lever which is situated at a distance from its bearing. This design of the clamping device is mechanically simple, so that it needs little maintenance and is not susceptible to wear. Furthermore, it is simple to operate. To this end, the clamping lever is made to engage with the latch and thus closed. On the other hand, little effort is required to release the clamping lever from its locked position at any desired time. Further, any wedging of the device is excluded.

At least two clamping levers and corresponding latches are preferably provided which are advantageously arranged symmetrically to each other. This again leads to a uniform transfer and application of the force, so that a uniform squeezing of the mop covering on both sides and over the entire surface of the holder board is obtained. If two or more clamping levers and corresponding latches are provided, the device advantageously comprises a connecting member that transfers the motion of a clamping lever to each other clamping lever. An opening or closing of all clamping levers can be obtained by a single manipulation.

The press jaws are advantageously provided with openings. This accelerates and improves the removal of the squeezed liquid from the press jaws. Otherwise, the liquid can only flow out through an opening between the press jaws in the closed position at the lower end of the press jaws in their built-in position.

Guiding elements are preferably provided at the end side faces of the first press jaw which serve to guide the motion of the first press jaw on the corresponding gliding surfaces of a standing and collecting means. This provides the entire design with greater stability when it is used in combination with such a collection means having corresponding gliding surfaces, since the motion of the press jaws will be guided and supported.

The guiding elements are advantageously situated in an upper part of the first press jaw and are designed as projections. This offers the advantage that the guiding elements can bear against the upper edge of a conventional bucket and that no special elements have to be provided on a collection receptacle, for example a bucket. Of course, the sliding surfaces of such a collection receptacle could nevertheless advantageously be designed in such a manner as to directly match the guiding elements. In contrast with grooves or slots provided in the bucket, this arrangement has additionally the advantage that dirty water or particles of dirt cannot become deposited in the corner areas of the grooves or slots, which is undesirable from a hygienical point of view, in particular, since those corner areas can be cleaned only with difficulties.

In accordance with a preferred embodiment, a gripping area is provided on the press lever. This particularly facilitates carrying the device at the gripping area. An appropriately shaped gripping area is furthermore convenient for the user when he performs the squeezing procedure and applies the press force.

The press lever preferably has a hook-shaped zone at an outer end. In connection therewith, the bearing point of the press lever is situated on the first press jaw between the hook-shaped zone and the gripping area. Such a hook-shaped zone has to be always provided if the device is to be mounted on an appropriately shaped receptacle in such a manner that the press lever simultaneously serves as a handle for carrying the device including the receptacle.

The hook-shaped zone can then be made to engage with an appropriate counterpart provided on the receptacle, and the grip on the press lever may simultaneously serve as a handle for carrying the device for squeezing liquid-absorbing wiper bodies as well as for a receptacle carrying this device, whereby the entire device is rendered very compact and simple to handle.

According to a preferred embodiment, the device further comprises a standing and collection means for the cleaning liquid squeezed out of the wiper body. This standing and collection means could advantageously also be a bucket. The standing and collection means, which may be designed integrated into the remaining device, is particularly advantageous if the device is used for industrial purposes, since in this case the squeezing device may be permanently connected to the standing and collection means and said standing and collection means is additionally adapted to the size of the squeezing device and, thus, to the size of the mop holder with the mop covering. This makes it possible to work in a particularly ergonomic manner.

A standing and collection means or the bucket is advantageously essentially of rectangular shape. This again corresponds to the form of the wiper mop with the mop covering to be squeezed used for cleaning.

The standing and collection means is advantageously provided with an edge area having two symmetrically arranged sliding surfaces. The guiding elements of the squeezing device can slide along these sliding surfaces, so that a stable overall design is obtained both for the squeezing operation and the movement of said means.

Advantageously, the standing and collection means is provided with at least one and, more advantageously, with two symmetrical projections situated in an upper, advantageously the centre part of the standing and collection means. Depending on the arrangement of the press lever, these projections have to be provided on the standing and collection means in a direction towards the inside or the outside. If a press lever with hook-shaped terminal areas is used, is they may engage with the projections. The press lever may then be used as a grip for carrying the entire device, since the load is transferred directly in the standing and collection means without causing additional stress for the squeezing device. Furthermore, the press lever can bear against these projections during its motion and the projections can serve as a stop in the open state, so that the first press jaw together with the second press jaw constitute a V-shape in the open state.

The squeezing device preferably extends over a part of an opening of the standing and collection means, where a part of the opening of the standing and collection means is left free which is advantageously as large as to permit a wiper mop with mop covering being dipped into the standing and collection means filled with cleaning liquid without the necessity to move or to remove the squeezing device. This is particularly advantageous if prior to squeezing also a cleaning of the mop covering in the cleaning liquid is intended.

To this end, it is advantageous if one of the press jaws is arranged in such a manner as to be parallel to an edge of the bucket.

Preferably, one of the press jaws directly abuts the edge of the bucket or even lies on it with the upper part of the press jaw. The press jaws advantageously essentially extend over the entire width of the standing and collection means. The external dimensions of the press jaws therefore essentially correspond to the internal dimensions of one side of the standing and collection means. This renders the device for squeezing liquid-absorbing wiper bodies particularly compact and space-saving.

BRIEF DESCRIPTION OF THE DRAWINGS

By way of example only, the invention is described in the following with the help of the accompanying drawings in which.

DETAILED DESCRIPTION

Figure 2:
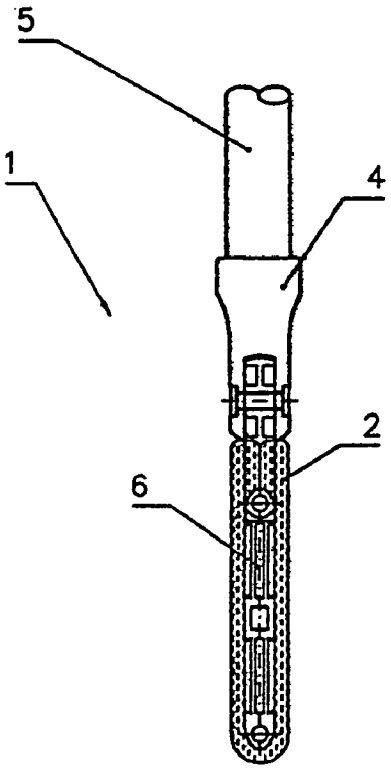
FIG. 2 shows a side elevation of a conventional holder with mop covering.
Figure 1:
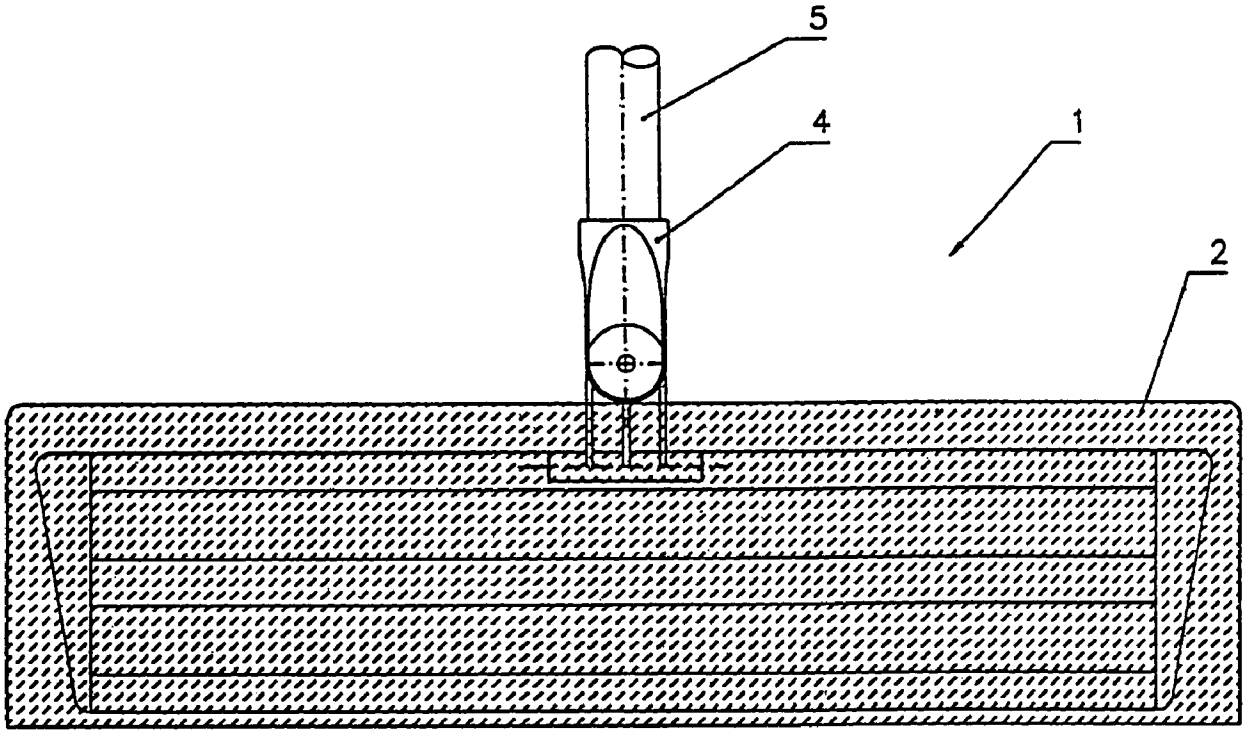
FIG. 1 shows a conventional mop holder with mop covering.

FIGS. 1 and 2 show a mop holder 1 with a mop covering 2 tensioned onto it of the type that is conventionally used for cleaning of floor surfaces in buildings. The mop holder 1 consists of a holder board 6 which is attached to a handle stick 5 by means of a stick holder 4. To this end, the stick holder 4 is provided with a double joint, so that the necessary swivel motions during wiping can be performed. A mop covering 2 is tensioned onto the holder board 6 which is, as a rule, designed such as to absorb moisture. The mop covering 2 is mounted to the holder board by means of a clamping system, such as VELCRO® hook and eye fastener strips, snap fasteners or the like.

Alternatively, it may have pockets which engage with corresponding projections of the holder board. As may particularly be seen in FIG. 2, the mop covering 2 is turned around the holder board 6 in the form a U, so that both sides of the plate surface of the holder board 6 are covered by the liquid-absorbing mop covering 2. This makes it possible to use both plate surfaces of the holder board for cleaning the floor before the mop covering 2 itself must be cleaned.

FIGS. 3 to 6 show an embodiment of the device 23 for squeezing mop coverings in accordance with the invention. In the embodiment here illustrated, the device 23 for squeezing liquid-absorbing wiper bodies comprises a bucket 7. As may be seen in the figures, the bucket 7 is essentially rectangular and has a bottom surface and an upper edge. A sliding surface 20 is provided at two opposite areas of the upper edge. The bucket 7 may be partially filled with cleaning liquid 24.

A squeezing device is attached to the bucket 7 by means of an attachment device not shown in the figure. The attachment device could consist, for example, of hook elements, groove-spring combinations, etc. Alternatively, the bucket 7 with the squeezing device could be produced as an integrated part, so that no detachment is possible.

The squeezing device 23 is provided with two press jaws 15 and 16 which are linked with each other at their lower ends when they are in the built-in position by means of an articulated joint 13. The first press jaw 15 is as a whole movable in relation to the bucket 7, while the second press jaw 16 is provided with a bearing point 11 at its upper end which permits the second press jaw 16 to rotate about the bearing point 11 with the bearing point 11 itself being fixed so that it cannot be rotated or shifted. The bearing point 11 is fixed to the bucket in such a manner that the second press jaw 16 is situated parallel to and in the immediate vicinity of one of the side faces of the bucket 7.

In an upper part of the first press jaw 15 a bearing 10 is likewise provided. The bearing 10 connects by an articulated joint a press lever 8 with the first press jaw 15. To this end, the bearing 10 is situated in the vicinity of a first end of the press lever 8, which is provided with a hook-shaped zone 18 at this end in the illustrated embodiment.

The press lever 8, which is preferably designed in the form of a U, is also provided with a grip area 9.

A clamping lever 14 is rotatably attached to the press lever 8 by means of a joint 12 situated in an area between the grip and the bearing point of the press lever at the first press jaw 15. When the press lever 8 is designed as a U, advantageously two such clamping levers 14 and corresponding bearings 12 are provided, each of which is attached to the legs of the U in the area between the bearing of the press lever 8 at the first press jaw 15 and the grip 9 at the press lever 8. Joint 12 also connects the press lever 8 and the clamping lever 14 in an articulated manner. At the end of the clamping lever 14 which is at a distance from the bearing point, a recess or a recess area is provided which engages with a latch 19 provided at the second press jaw 16. In the illustrated embodiment, the bucket 7 is also provided with stud-like projections 17 serving as a stop for the press lever 8 and which can engage with the hook-shaped area 18 of the press lever 8. In the illustrated embodiment, the projections 17 are provided on the outside of the bucket, where thus also the guidance of the grip is performed.

If more than one clamping lever 14 is provided, it is advantageous to join the clamping levers by means of a connecting member, so that a rotary motion of a clamping lever is automatically transmitted to the others.

Finally, in the illustrated embodiment, the press jaws 15 and 16 are provided with openings 21 and 22 which serve for an improved discharge of the squeezed cleaning liquid.

In the following, the mode of operation of the device 23 for squeezing liquid-absorbing wiper bodies is described with reference to FIGS. 3 to 6.

Figure 3:
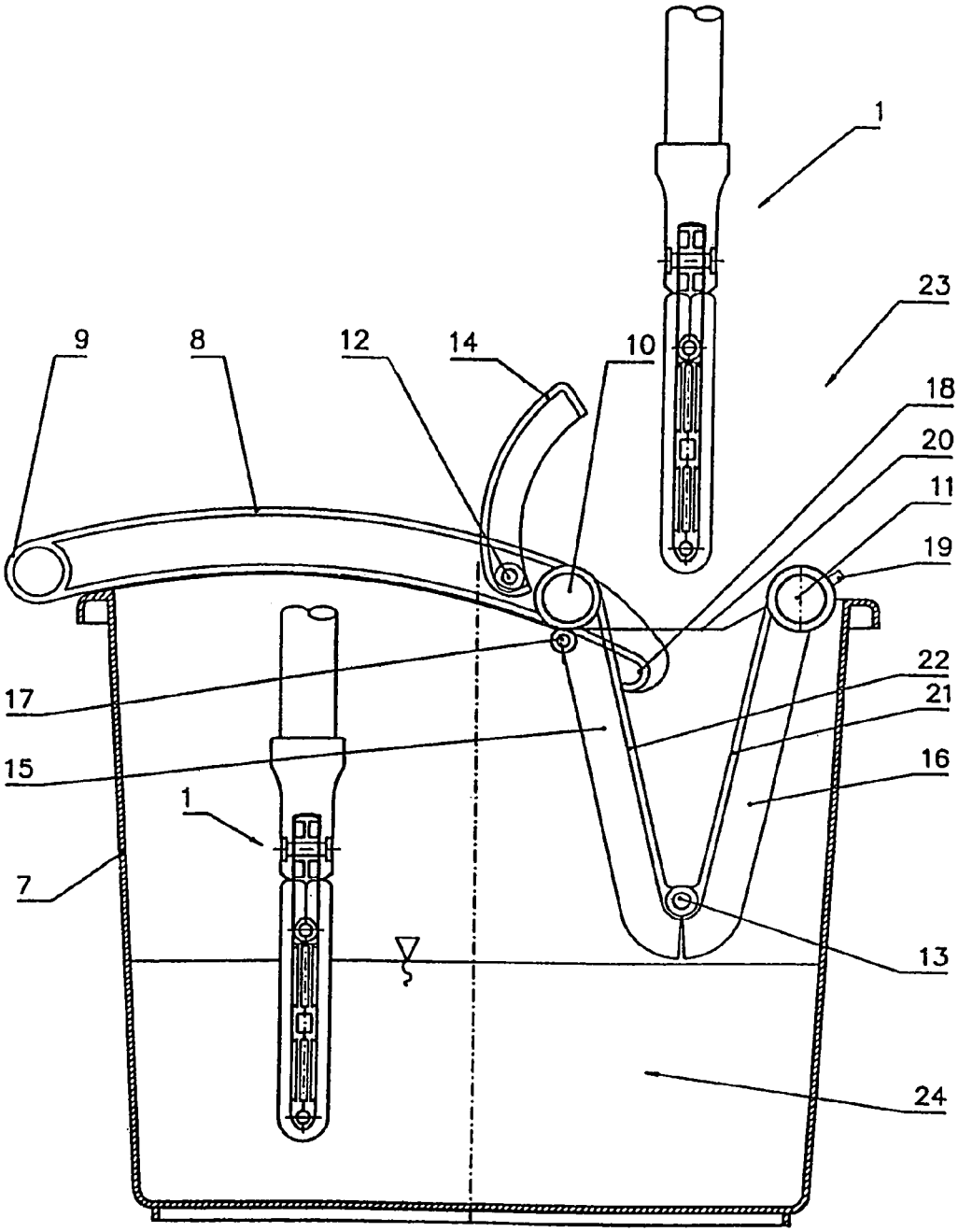
FIG. 3 shows an embodiment of the device in accordance with the invention in the open state.

The bucket 7 shown in FIG. 3 is filled with cleaning liquid 24 to a level permitting a mop holder with a mop covering tensioned thereon to be completely dipped into the liquid with the liquid remaining below the squeezing device. If a mop covering 2 tensioned onto a mop holder 1 is to be cleaned, it is first dipped into the cleaning liquid 24 before the mop holder 1 with the mop covering 2 tensioned onto it is withdrawn from the liquid. This is shown in the left-hand half of FIG. 3. Since the press lever 8 is designed in the form of a U, it is possible to pass the mop holder 1 with the tensioned mop covering 2 through the aperture area between the U of the press lever that is not occupied by the squeezing device if the press lever 8 lies on the edge of the bucket.

Thereafter, the mop holder 1 with the tensioned mop covering is withdrawn through the same aperture defined by the U-shaped press lever 8 or the edge of the bucket and the upper edge of the first press jaw 15. The mop holder 1 with the tensioned mop covering 2 is then introduced into the area enclosed by the first press jaw 15 and the second press jaw 16 when it is in the open state. In the open state, the press jaws 15, 16 constitute a V-shape. In this state, the clamping levers 14 are in their rearward position, as shown in FIG. 3. The press lever 8 rests on one or two symmetrically arranged stop studs 17 and the press, defined by the first press jaw 15 and the second press jaw 16, is open.

Figure 4:
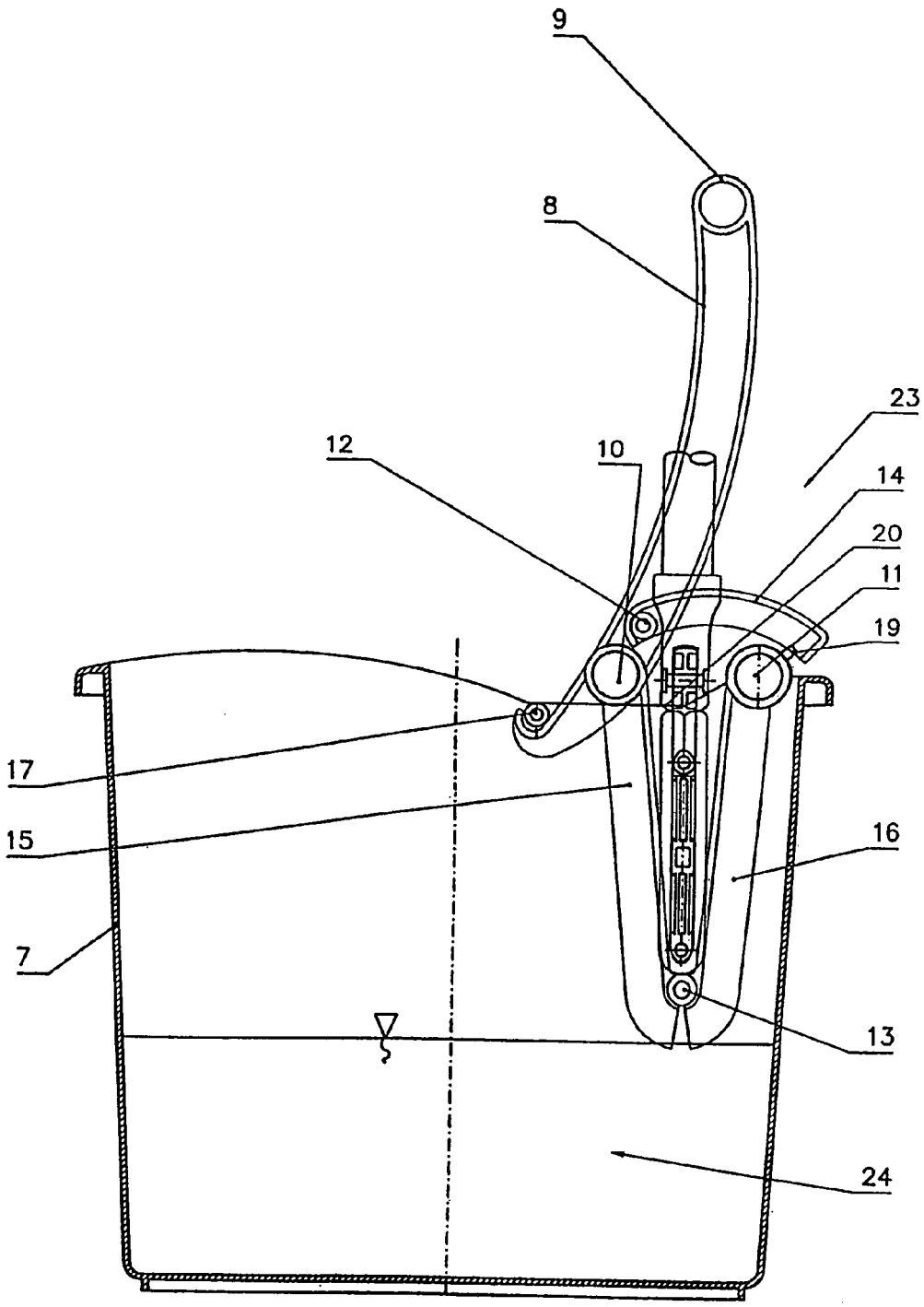
FIG. 4 shows an embodiment of the device in accordance with the invention while the clamping levers engage with the latches.

As shown in FIG. 4, the mop holder 1 with the tensioned mop covering 2 is then guided vertically downwards in such a manner to become laterally enclosed by the first and second press jaw 15, 16. When the mop holder 1 with the mop covering has been introduced deep enough, the lever 9 is moved due to rotation about the bearing point 10 in the direction towards the mop holder 1 and the remaining squeezing device, which causes the clamping levers 14 to swivel downwards and to engage with the latches 19 provided on the second press jaw 16.

Figure 5:
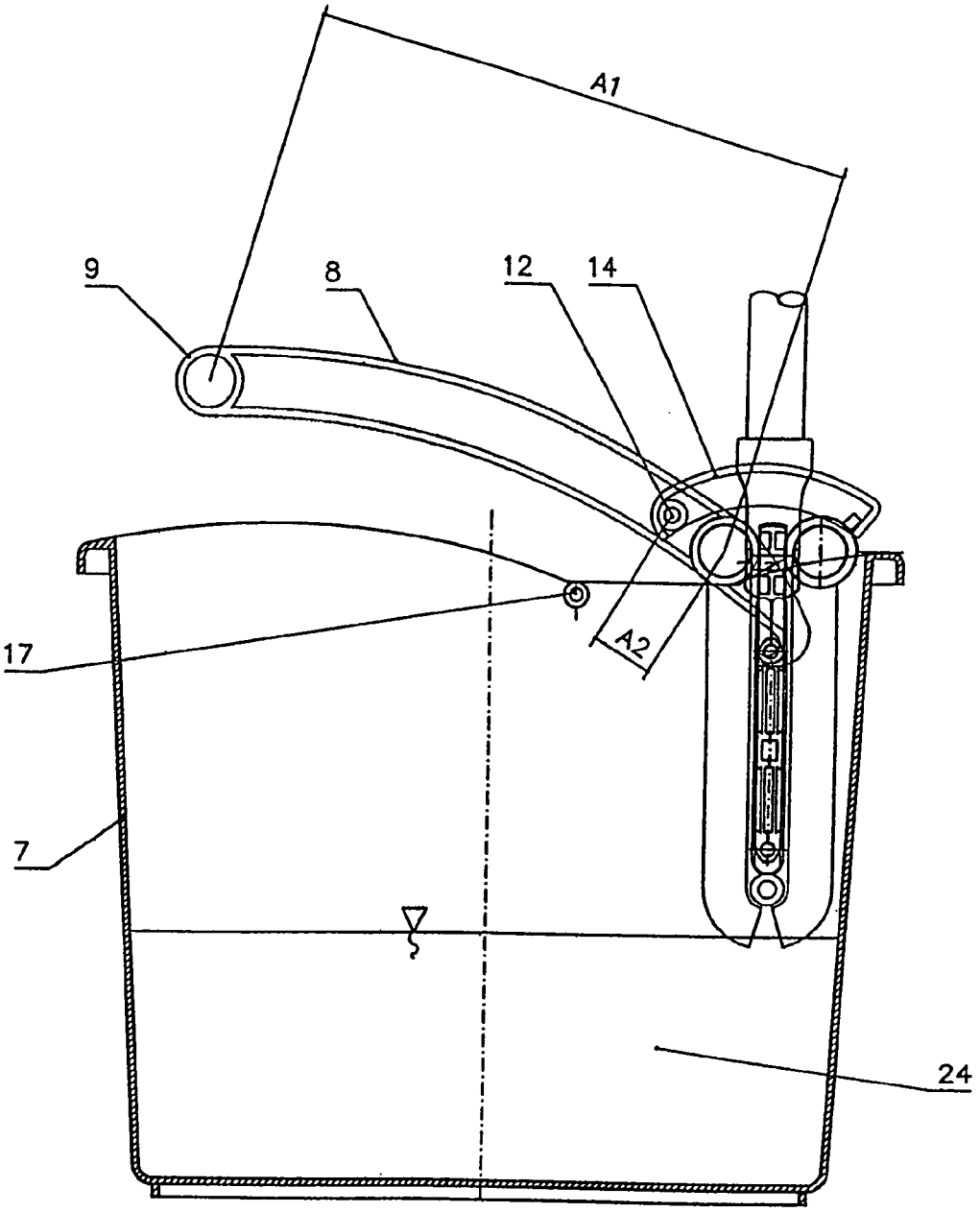
FIG. 5 shows an embodiment of the device in accordance with the invention during the pressing operation.

The squeezing device is thus closed, but a squeezing pressure is not exerted. In order to exert such a squeezing pressure onto the board faces 6 of the mop holder 1 with the mop covering 2 via the two press jaws, the press lever 8 is withdrawn as shown in FIG. 5, while the clamping levers 14 remain engaged with the latches 19. This has the effect that the bearing point 10 between the first press jaw 15 and the press lever 8 moves towards the bearing point 11 between the second press jaw 16 and the bucket 7 thereby causing the first pressure jaw 15 to become parallel to the second press jaw 16 and to transfer a squeezing pressure applied by the operation of the press lever 8 to the board faces 6 of the mop holder 1 with the mop covering 2 tensioned thereon. The fact that the press jaws 15 and 16 are parallel to each other and to the board faces of the mop holder 1, assures a uniform squeezing of the entire mop covering 2. The water or cleaning liquid squeezed out can flow out through the corresponding openings 21 and 22 and through a lower opening between the press jaws 15, 16 and is collected in the bucket 7.

By correspondingly designing the distance A1 from the grip of the press lever to the bearing point 10 between press lever and first press jaw 15 and the distance A2 between the bearing point of the clamping levers at the press lever 8 and the bearing point 10 of the press lever 8 at the first press jaw, a large load transmission of the manual force applied is obtained which may, for example, be in the range of from 1 and 10. An effective squeezing of a textile mop covering 2, which may, for example, have fringes and loops, is obtained by strongly pressing these elements against each other.

On completion of the squeezing procedure, the press lever 8 is again rotated in the direction towards the squeezing device (in the clockwise direction in FIG. 5) and occupies again the position shown in FIG. 3, while the upper parts of the press jaws 15 and 16, as shown in FIG. 4, come to lie further apart and thus constitute a slight V. Subsequently, the connection between the clamping levers 14 and the latches 19 is opened in that the clamping levers are folded up (in the counterclockwise direction in FIG. 5) and the press lever can be deposited on the edge of the bucket in its initial position, which is shown in FIG. 3. This is possible if the press lever 8 and the edge of the bucket are correspondingly designed. Using the handle stick 5 of the holder, the squeezed mop covering 2 mounted on the holder can be removed from the device for squeezing liquid-absorbing wiper bodies by an upward movement.

Figure 6:
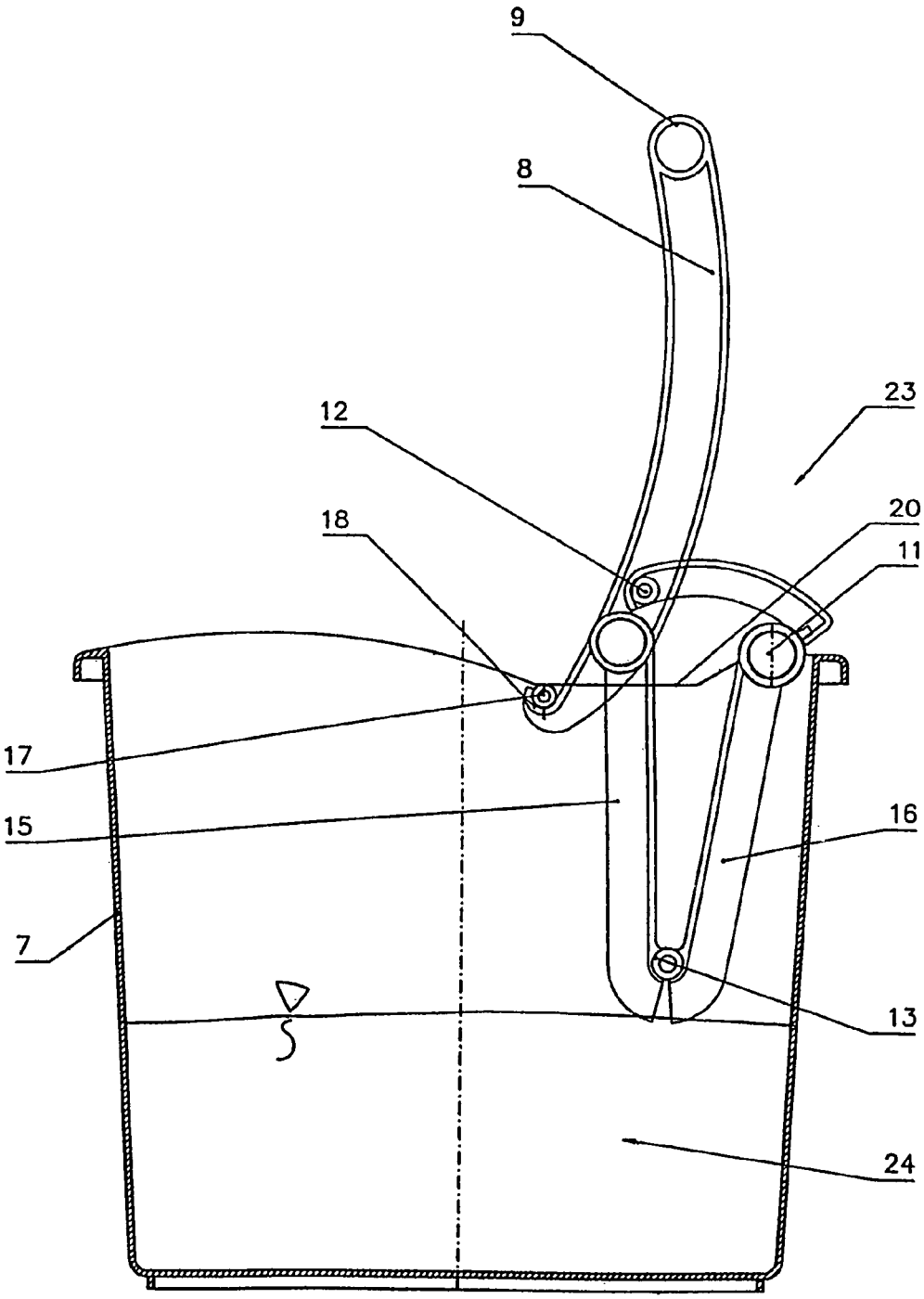
FIG. 6 shows an embodiment of the device in accordance with the invention in transportation position.

If the bucket 7 including the squeezing device is to be transported, the grip 9 of the press lever 8 can also be used for this purpose. To this end, the hook-shaped area 18 is made to engage with the latches 17 provided on the bucket 7. This assures that the force applied as a result of the carrying will be transferred directly to the bucket 7, thus preventing damage to the squeezing device. This carrying position is shown in FIG. 6. It may be seen that the clamping levers 14 also engage with the latches 19, with the press, of course, not being operated. In order to allow a stable carrying without risk of spilling out cleaning liquid, it is appropriate to provide the projections 17 in an area close to the axis of symmetry of the bucket, as to grip the bucket as close as possible to or vertically above its centre of gravity.

The entire squeezing device may be designed either as an integral part of the bucket or it may be designed to be mountable on a bucket with the help of snap-on connections or the like.

An essential aspect of the arrangement in accordance with the invention consists in that a high squeezing force can be applied to a mop covering tensioned onto a mop holder with a high force transmission reducing the expenditure of force to be exerted by a user. Furthermore, by the parallel position of the press jaws during squeezing a uniform squeezing effect onto the entire wiper body is obtained. By a corresponding design of a bucket, an additional grip may completely be dispensed with.

What is claimed is:

1. A device for squeezing liquid-absorbing wiper bodies comprising:

first and second press jaws, each of which has two principal faces and side faces at right angles thereto, where the first press jaw is connected with the second press jaw by an articulated joint;

a press lever connected with the first press jaw by an articulated joint;

a clamping device for clamping the first and the second press jaws, said clamping device being connected with the press lever; and a bearing point provided on the second press jaw, the bearing point being fixed.

2. A device in accordance with claim 1, characterized in that the press jaws are essentially rectangular, so that in their built-in position each of them has two end side faces, as well as an upper side face and a lower side face.

3. A device in accordance with claim 1, characterized in that the articulated joint between the first and the second press jaws is situated in a lower part of the press jaws when they are in their built-in position and that the press lever is mounted at a bearing point of the first press jaw at a distance from the joint between the first and the second press jaws.

4. A device in accordance with claim 1, characterized in that the press lever is U-shaped.

5. A device in accordance with claim 4, characterized in that the press lever is borne by two bearing points on the first press jaw arranged in symmetrical positions with respect to each other.

6. A device in accordance with claim 5, characterized in that each bearing point is situated on an end side face of the press jaws.

7. A device in accordance with claim 1, characterized in that the clamping device consists of at least one clamping lever and at least one latch, with the clamping lever being connected to the press lever by means of an articulated joint in an area between the bearing point of the press lever and the end press lever at a distance from said first press jaw in the vicinity of said bearing point and the latch is fixed to the second press jaw, so that it can be made to engage with the clamping lever.

8. A device in accordance with claim 7, characterized in that at least two clamping levers and latches are provided and are situated in symmetrical psitions with respect to each other.

9. A device in accordance with claim 1, characterized in that the press jaws are provided with openings.

10. A device in accordance with claim 1, characterized in that a grip area is provided on the press lever.

11. A device in accordance claim 10, characterized in that the press lever comprises a hook-shaped area at an outer end and that a bearing point of the press lever is situated on the first press jaw between the hook-shaped area and the grip area.

12. A device in accordance with claim 1, comprising further a standing and collection means.

13. A device in accordance with claim 12, characterized in that the standing and collection means is a bucket.

14. A device in accordance with claim 13, characterized in that the bucket is essentially rectangular.

15. A device in accordance with claim 12, characterized in that the standing and collection means is provided with at least one projection situated in an upper part of the said standing and collection means such that the press lever abuts the projection in the open state and bears against it during a movement.

16. A device in accordance with claim 12, characterized in that the squeezing device extends over a part of an opening of the standing and collection means.

17. A device in accordance with claim 16, characterized in that the press lever in the open state leaves free a further part of an area of the opening in the standing and collection means which is at least so large that the wiper body can be passed through.

18. A device in accordance with claim 12, characterized in that the press jaws essentially extend over the entire width of the standing and collection means.

* * * * *

UNITED STATES PATENT AND TRADEMARK OFFICE

CERTIFICATE OF CORRECTION

PATENT NO. : 6,996,873 B2
DATED : February 14, 2006
INVENTOR(S) : Dirk Salmon

It is certified that error appears in the above-identified patent and that said Letters Patent is hereby corrected as shown below:

Column 10,
Line 19, "psitions" should be -- positions --.
Line 25, -- with -- should be added after "accordance".

Signed and Sealed this

Twenty-fifth Day of April, 2006

JON W. DUDAS
*Director of the United States Patent and Trademark Office*